US010386028B2

(12) United States Patent
Xu

(10) Patent No.: US 10,386,028 B2
(45) Date of Patent: Aug. 20, 2019

(54) FAST-MOUNTED CEILING LAMP CONVENIENT IN WIRING

(71) Applicant: Dongguan Yinghui Lighting Co., Ltd., Dongguan, Guangdong (CN)

(72) Inventor: Shuisheng Xu, Guangdong (CN)

(73) Assignee: DONGGUAN YINGHUI LIGHTING CO., LTD., Dongguan, Guangdong (CN)

( * ) Notice: Subject to any disclaimer, the term of this patent is extended or adjusted under 35 U.S.C. 154(b) by 0 days.

(21) Appl. No.: 16/003,361

(22) Filed: Jun. 8, 2018

(65) Prior Publication Data

US 2018/0356057 A1 Dec. 13, 2018

(30) Foreign Application Priority Data

Jun. 8, 2017 (CN) ..... 2017 1 0428338

(51) Int. Cl.

| | |
|---|---|
| ***F21S 8/04*** | (2006.01) |
| ***F21V 21/03*** | (2006.01) |
| ***F21V 17/12*** | (2006.01) |
| ***F21V 17/16*** | (2006.01) |
| *F21V 23/00* | (2015.01) |

(52) U.S. Cl.

CPC ..... *F21S 8/04* (2013.01); *F21V 17/12* (2013.01); *F21V 17/164* (2013.01); *F21V 21/03* (2013.01); *F21V 23/001* (2013.01)

(58) Field of Classification Search

CPC .... F21S 8/04; F21S 8/02; F21V 17/12; F21V 17/164; F21V 21/03; F21V 23/001

See application file for complete search history.

(56) References Cited

U.S. PATENT DOCUMENTS

| | | | | |
|---|---|---|---|---|
| 5,609,414 | A * | 3/1997 | Caluori | F21S 8/02 248/27.1 |
| 5,941,625 | A * | 8/1999 | Morand | F21S 8/02 248/343 |
| 6,149,280 | A * | 11/2000 | Quiogue | F21S 8/02 362/147 |
| 2015/0292717 | A1* | 10/2015 | Xu | F21V 17/162 362/382 |
| 2016/0356462 | A1* | 12/2016 | O'Brien | F21V 21/02 |

* cited by examiner

*Primary Examiner* — Anne M Hines

(74) *Attorney, Agent, or Firm* — Jackson IPG PLLC; Demian K. Jackson

(57) ABSTRACT

A fast-mounted ceiling lamp convenient in wiring comprises a mounting frame, a base, a light source assembly and a lampshade, wherein a hook is arranged at one end of the mounting frame, a clamping ring is arranged on an outside wall of the base, the hook is hooked into the clamping ring, and a vertical beam of the mounting frame is fixedly connected to the base; a plurality of mounting parts are arranged on the outside wall of the base, and a plurality of elastic clamping sheets are arranged on an inside surface of the lampshade and are clamped onto the mounting parts. According to the fast-mounted ceiling lamp disclosed by the present invention, by arranging the hook on the mounting frame, the base can be directly hooked to the mounting frame when a wire on the base is connected to or disconnected from an external wire, without manual lifting.

11 Claims, 7 Drawing Sheets

FAST-MOUNTED CEILING LAMP CONVENIENT IN WIRING

FIELD OF THE INVENTION

The present invention relates to an illumination lamp, and more particularly to a fast-mounted ceiling lamp convenient in wiring.

BACKGROUND OF THE INVENTION

Ceiling lamps are widely applied to ceilings or wall surfaces in indoor lighting places by means of their characteristics of simple mounting, and simple and elegant styles. When the ceiling lamp is mounted, it is necessary to connect a wire on the ceiling lamp to an external power wire. However, during the wiring of the traditional ceiling lamp, it is necessary to lift the ceiling lamp with one hand, and connect a wire with the other hand, thereby bringing inconvenience in operation and causing low mounting efficiency.

In addition, the traditional ceiling lamp usually comprises a bottom housing, a light source and a lampshade. During mounting, it is necessary to dismantle the lampshade or the lampshade and the light source, fixedly mount the bottom housing on a ceiling or a wall, and then mount the lampshade or the lampshade and the light source to the bottom housing through elastic clamping sheets. However, this ceiling lamp is very inconvenient to mount, time-consuming and labor-consuming, and is likely to be damaged during mounting and dismounting because installation personnel are nonprofessional assembly personnel.

SUMMARY OF THE INVENTION

Therefore, an objective of the present invention is to provide a fast-mounted ceiling lamp convenient in wiring, so as to solve the problem of inconvenience in wiring of the ceiling lamp.

To achieve said objective, the present invention mainly adopts the following technical solutions.

A fast-mounted ceiling lamp convenient in wiring comprises a mounting frame, a base, a light source assembly and a lampshade, wherein a crossbeam and vertical beams arranged at two ends of the crossbeam are arranged on the mounting frame, wherein a hook is arranged at the end of one vertical beam; a clamping ring is arranged on an outside wall of the base, the hook is hooked into the clamping ring, and the other vertical beam of the mounting frame is fixedly connected to the base; a plurality of mounting parts are also arranged on the outside wall of the base; a concave press-fit part is arranged in the middle of a top surface of each mounting part; a plurality of elastic clamping sheets are arranged on an inside surface of the lampshade; each elastic clamping sheet comprises a positioning part, and a connecting part and an extension part which are connected to two ends of the positioning part, wherein the connecting part is fixed inside the lampshade; the lampshade is adapted to the base; the lampshade is rotated to clamp the elastic clamping sheets into the mounting parts; the positioning part of each elastic clamping sheet is clamped to the press-fit part of the corresponding mounting part; the lampshade and the base define an accommodating space in which the light source assembly is mounted.

Further, the positioning part is arranged horizontally; the extension part extends obliquely towards the outer side above the lampshade; the connecting part is U-shaped; the connecting part is arranged below the outer side of the positioning part, and an opening of the connecting part faces upwards.

Further, a corner is arranged at positions where the positioning part, the extension part and the connecting parts are connected, respectively; faces of the corner, which are in contact with the base, are arc-shaped.

Further, a bottom end surface of the positioning part protrudes downwards to form a plurality of raised points; a surface of each raised point, which is in contact with the mounting part, is arc-shaped.

Further, an annular limiting plate is arranged on the lampshade; the limiting plate is provided with a plurality of step surfaces which are arranged in a form of steps; the elastic clamping sheets are fixedly arranged on the step surface at the outermost side.

Further, a guide part is arranged at the left side of the press-fit part in an extension direction of the mounting part; a limiting part is arranged at the right side of the press-fit part; the limiting part protrudes out of the press-fit part; the guide part is arranged obliquely downwards from left to right.

Further, a limiting part is respectively arranged at two sides of the press-fit part; the limiting parts protrude out of the press-fit part; the press-fit is arranged obliquely in a direction from one limiting part to the other limiting part.

Further, a top surface of a cross section of the press-fit part is of a structure which descends from outside to inside; the shape of the positioning part of the elastic clamping sheet is the same as that of the top surface of the cross section of the press-fit part.

Further, the crossbeam is provided with positioning holes, and screws penetrate through the positioning hole to fix the mounting frame onto a ceiling or a wall.

Further, the elastic clamping sheet is made of a metal material.

From the above, according to the fast-mounted ceiling lamp disclosed by the present invention, by arranging the hook on the mounting frame, the base can be directly hooked to the mounting frame when a wire on the base is connected to or disconnected from an external wire, without manual lifting, and therefore the operation is more convenient and the working efficiency is high. In addition, due to the arrangement of the elastic clamping sheets and the mounting parts, the elastic clamping sheets are rotatably clamped to the mounting parts, such that the base can be connected to or disconnected from the lampshade conveniently, and the mounting is stable. The fast-mounted ceiling lamp disclosed by the present invention has the advantages of strong practicability and great significance in promotion.

DETAILED DESCRIPTION OF THE PREFERRED EMBODIMENTS

Figure 1:
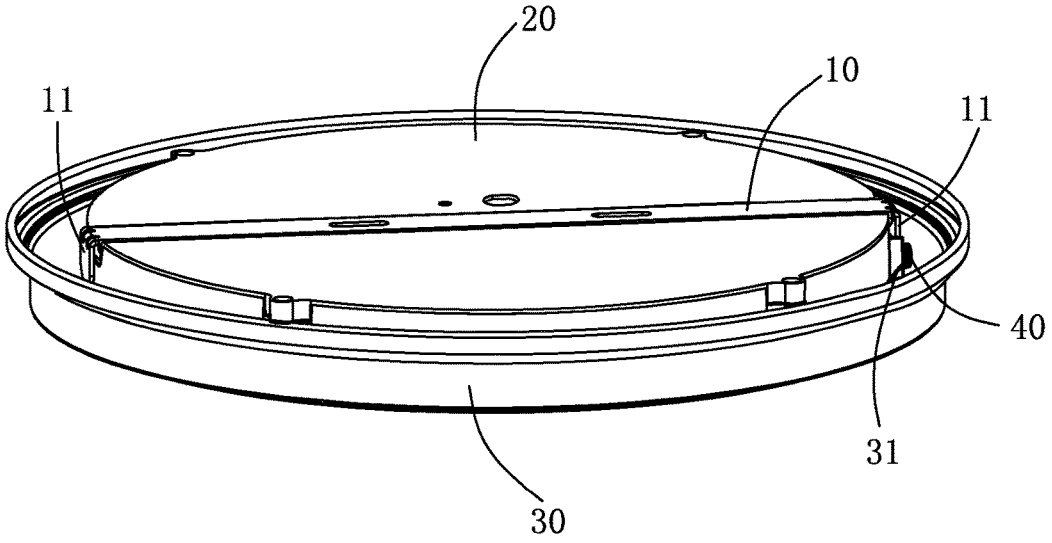
FIG. 1 is a structural schematic drawing of a first embodiment of a fast-mounted ceiling lamp convenient in wiring according to the present invention.
Figure 2:
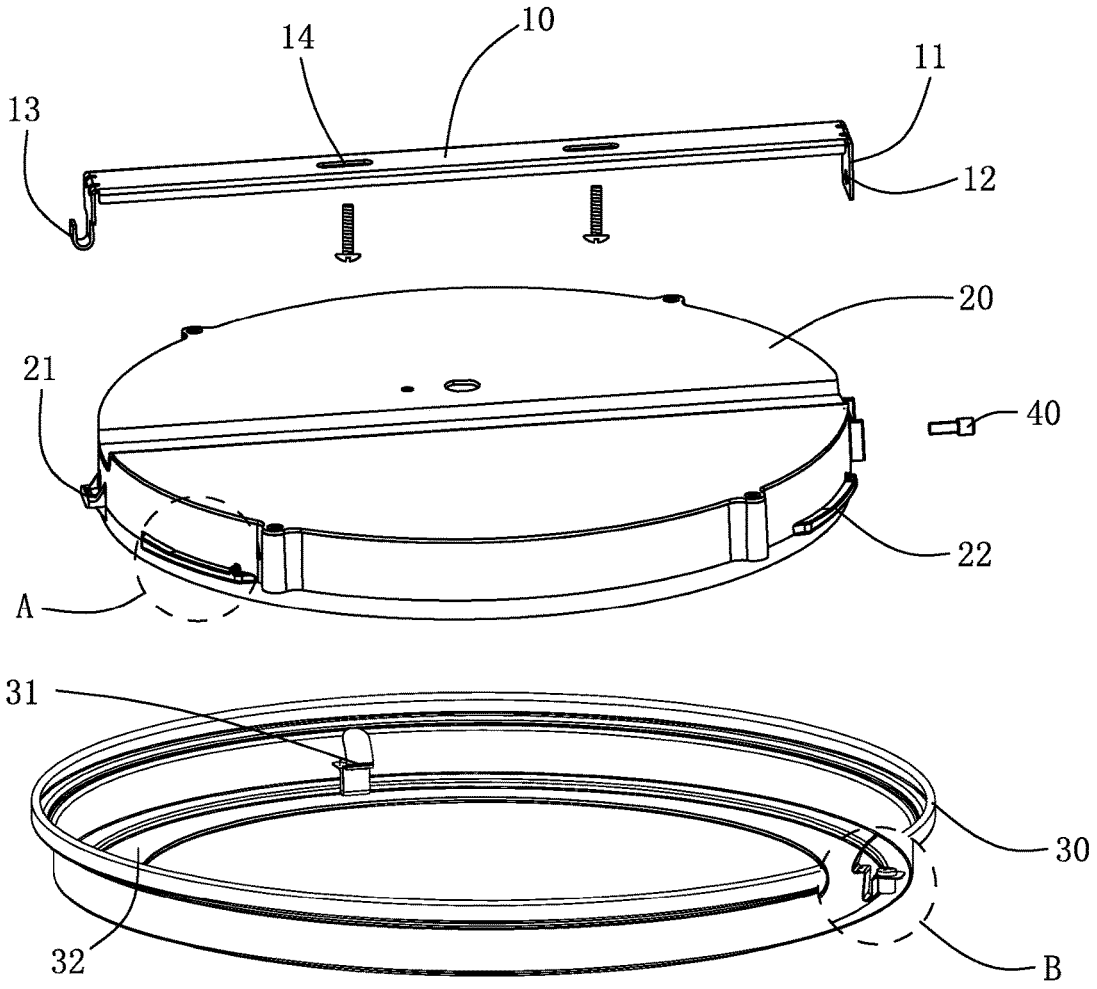
FIG. 2 is an exploded schematic drawing of the fast-mounted ceiling clamp convenient in wiring as shown in FIG. 1, wherein a part A is a cross-sectional representation.
Figure 3:
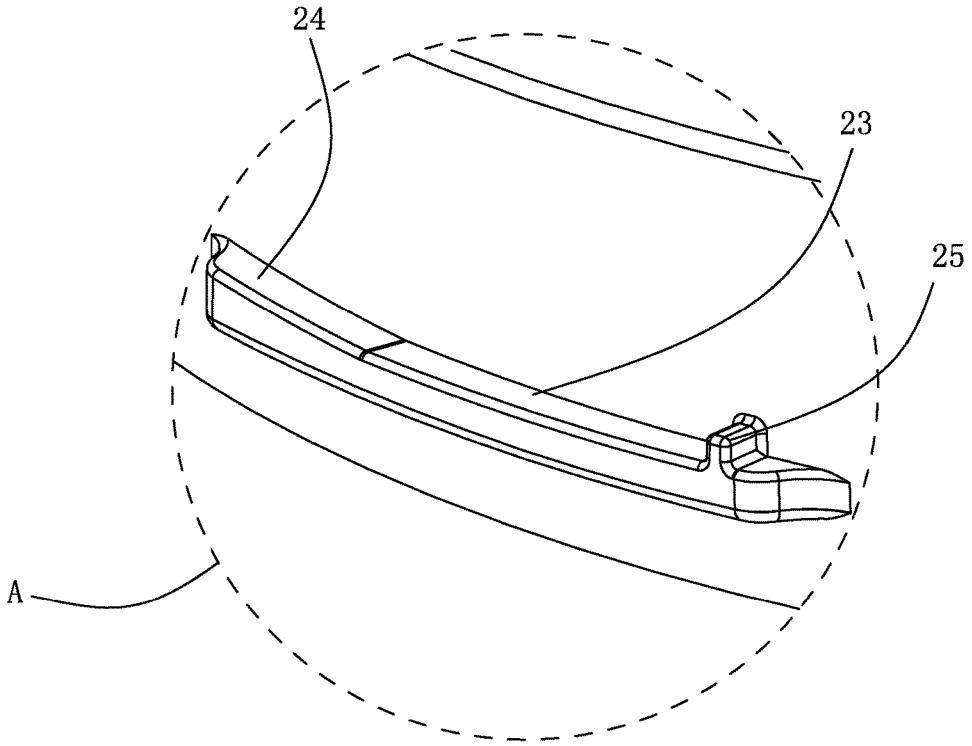
FIG. 3 is an enlarged schematic drawing of the part A in FIG. 2.
Figure 4:
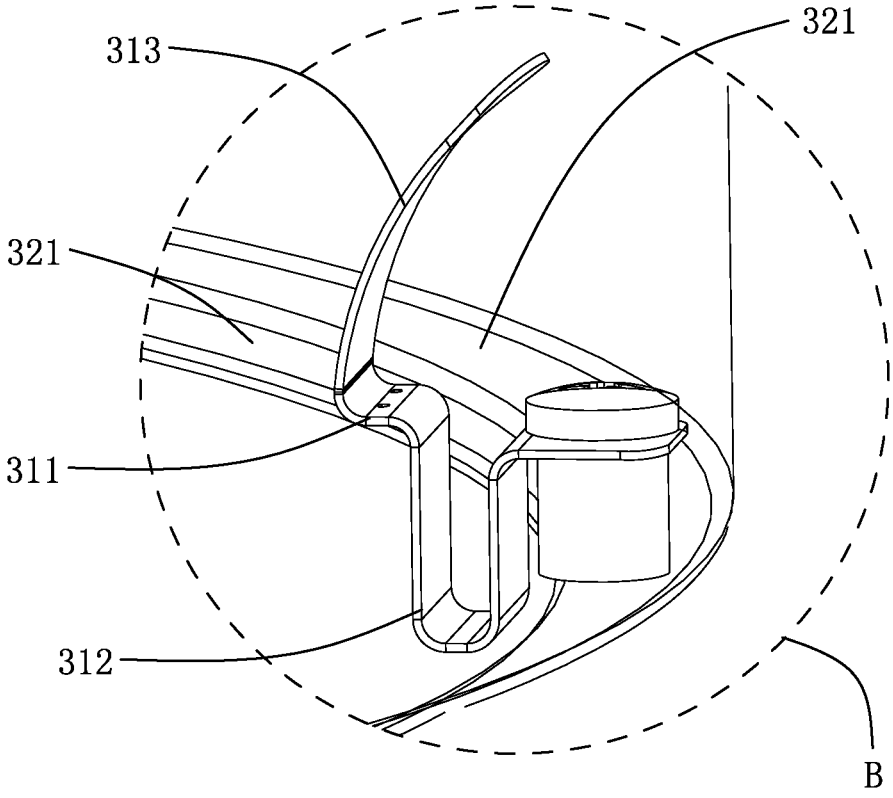
FIG. 4 is an enlarged schematic drawing of a part B in FIG. 2.
Figure 5:
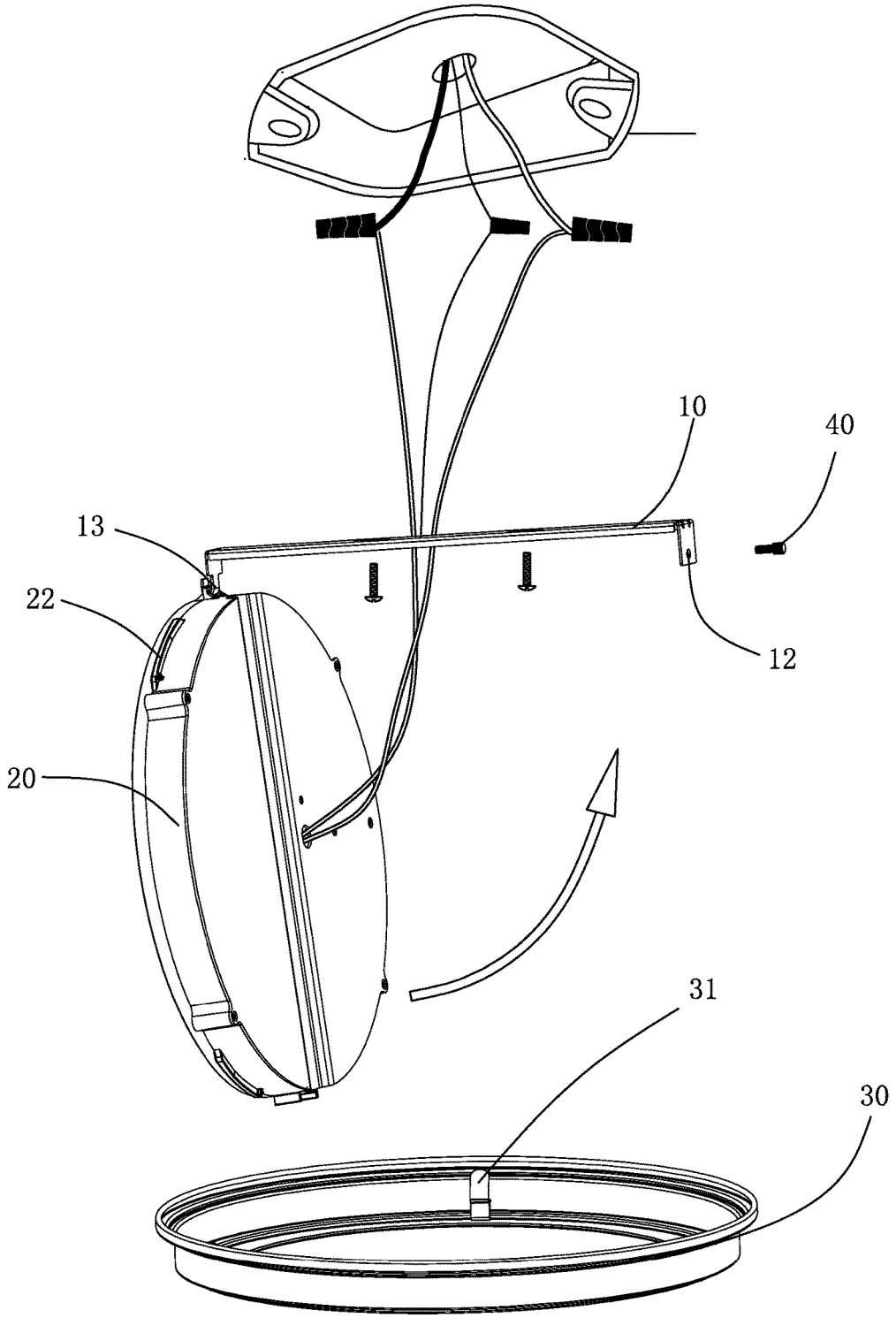
FIG. 5 is an assembled schematic drawing of FIG. 1.

The present invention will be further described in detail as below in conjunction with the drawings and the embodiments, in order to make the objective, the technical solutions and the advantages of the present invention understand more clearly.

As shown in FIGS. 1 to 5, the present invention provides a fast-mounted ceiling lamp convenient in wiring. The fast-mounted ceiling lamp convenient in wiring comprises a mounting frame 10, a base 20, a light source assembly and a lampshade 30, wherein the base 20 is arranged on the mounting frame 10; the lampshade 30 is arranged on the base 20 and defines an accommodating space together with the base 20; the light source assembly is arranged inside the accommodating space.

The mounting frame 10 comprises a crossbeam and two vertical beams 11 arranged vertically. It may be understood that the mounting frame 10 may also be provided with more than two vertical beams 11 in other embodiments. The crossbeam is embedded on the base 11. It may be understood that the crossbeam may also protrude out of the base 10 or is arranged on the base 10 in a spacing manner. The crossbeam is provided with a plurality of positioning holes, and screws penetrate through the positioning holes to fix the mounting frame 10 onto a ceiling or a wall. One of the two vertical beams 11 is provided with a mounting hole 12, and a hook 13 is arranged at the tail end of the other vertical beam 11. The outside wall of the base 20 is provided with a positioning hole (not shown) and a clamping ring 21, the hook 13 of the mounting frame 10 is hooked into the clamping ring 21, and a screw 40 sequentially penetrates through the mounting hole 12 and the positioning hole, so as to fix the mounting frame 10 onto the base 20.

The outside wall of the base 21 is further provided with a plurality of mounting parts 22. In the present embodiment, the mounting parts 22 protrude out of an outside surface of the base 20. In other embodiments, the outer surfaces of the mounting parts 22 may also be flush with the outer surface of the base 20, or recessed inwards to the outer surface of the base 20. A concave press-fit part 23 is arranged on a top end surface of each mounting part 22 and located in the middle of the mounting part 22. A guide part 24 is arranged at the left side of each press-fit part 23 in an extension direction of the mounting part 22. A limiting part 25 is arranged at the right side of each press-fit part 23 and protrudes out of the press-fit part 23. The guide part 23 extends obliquely downwards from left to right. In addition, a cross section of the press-fit part 22 is arranged obliquely in a shape which descends from outside to inside.

A plurality of elastic clamping sheets 31 is arranged on an inside wall of the lampshade 30 and are fixedly mounted to the lampshade 30 through screws. It may be understood that the elastic clamping sheets 31 may also be directly molded to the lampshade 30, or fixedly mounted to the lampshade 30 in other manners. One end of each elastic clamping sheet 31 is fixed to the lampshade 30, and the other end thereof extends towards a center direction of the lampshade 30. Each elastic clamping sheet 31 comprises a positioning part 311, and a connecting part 312 and an extension part 313 which are connected to two ends of the positioning part 311, wherein the connecting part 312 is fixed to the lampshade 30. The positioning part 311 is arranged horizontally. The extension part 313 extends obliquely towards the outer side above the lampshade 30. The connecting part 311 is U-shaped and arranged below the positioning part 312, and an opening of the connecting part 311 faces upwards.

The joints of the positioning part 312, the extension part 313 and the connecting part 311 are arc-shaped respectively, thereby preventing corners from scraping a paint layer on the outer surface of the base 20. A bottom end of each positioning part 311 extends downwards to form a plurality of raised points which are arranged in a spherical shape. The arc-shaped angles and the raised points may prevent from scraping the paint layer on the outer surface of the base 20. Due to the connecting parts 311, the elasticity of the elastic clamping sheets 31 can be increased, such that the elastic clamping sheets 31 may be clamped and mounted more conveniently. A limiting plate 32 is arranged below the elastic clamping sheets 31 and is annularly disposed. The limiting plate 32 is provided with a plurality of step surfaces 321 which are arranged in a form of steps and gradually descend gradually from outside to inside. The elastic clamping sheets 31 are fixed to the step surface 321 at the outermost side. The lampshade 30 is arranged on the base 20. A lower end surface of the base 20 is fitted to the limiting plate 32.

During mounting, the hook 13 on the mounting frame 10 is hooked into the clamping ring 21 on the base 20, and then the base 20 is hung onto the mounting frame 10. Therefore, during a wiring operation, the wiring operation may be performed by installation personnel with both hands, the wiring is convenient and the wiring efficiency is high. After the wiring between the ceiling lamp and an external power wire is completed, the other end of the mounting frame 10 is fixedly connected to the base 20 through the screw 40, and therefore the base 20 is fixedly mounted to the mounting frame 10. Then, the lampshade 30 is pushed upwards to the base 20 and is rotated, such that the elastic clamping sheets 31 are clamped to the press-fit parts 23 on the mounting parts 22, thereby completing the mounting of the ceiling lamp. During dismounting, the elastic clamping sheets 31 are rotated towards the guide parts 24 and are thus guided out from the guide parts, such that the lampshade 30 may be withdrawn from the base 20; then, the screws for fixedly connecting the base 20 and the mounting frame 10 are removed, such that the base 20 is vertically hung onto the mounting frame 10, and the wire of the ceiling lamp is then disconnected from an external wire.

Figure 6:
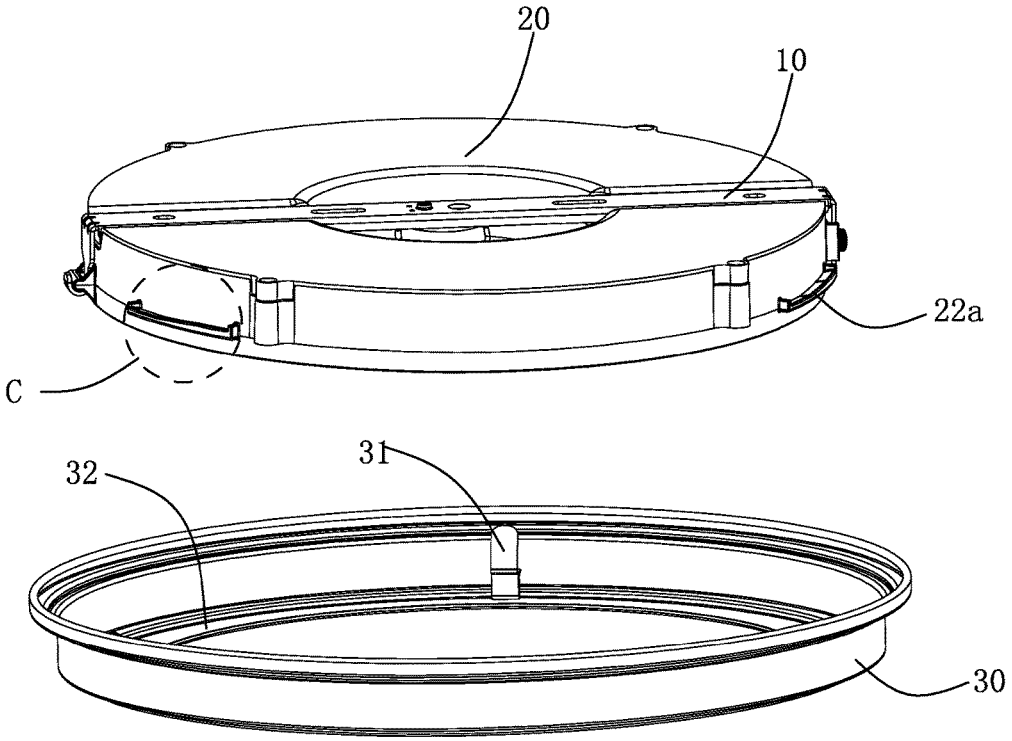
FIG. 6 is a structural schematic drawing of a second embodiment of the fast-mounted ceiling lamp convenient in wiring according to the present invention.
Figure 7:
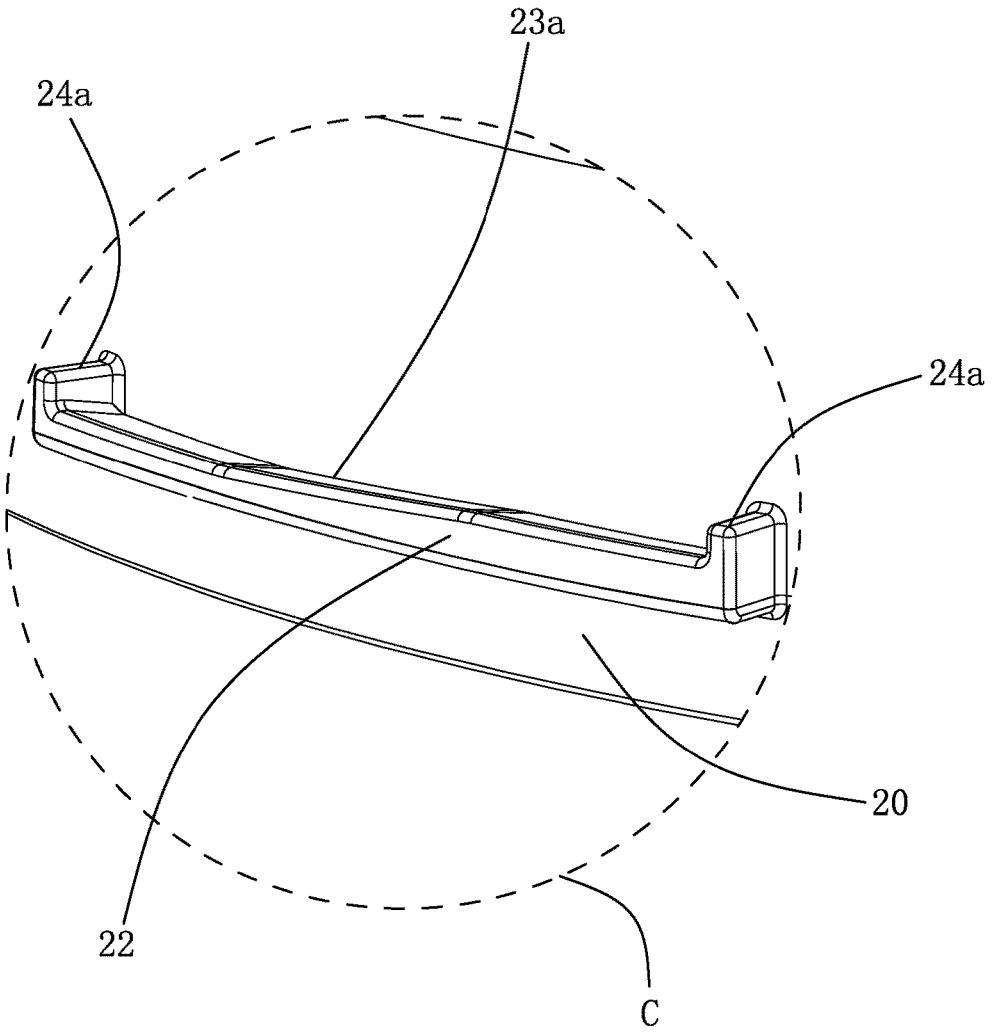
FIG. 7 is an enlarged schematic drawing of a part C in FIG. 6.

As shown in FIGS. 6 and 7, there is provided a second embodiment of the fast-mounted ceiling lamp convenient in wiring provided by the present invention. The present embodiment is basically the same as the first embodiment in structure. The difference therebetween lies in that: in the present embodiment, no guide part is arranged at the left side of a press-fit part 23*a* of each mounting part 22*a*; a limiting part 24*a* is respectively arranged at both sides of the press-fit part 23*a*; the press-fit part 23*a* extends obliquely upwards gradually along an extending direction thereof; in the present embodiment, the press-fit part 23*a* extends upwards from left to right. It may be understood that the press-fit part 23*a* may also extend upwards from right to left in other embodiments. The cross-section of the press-fit part 23*a* is arranged in a manner of descending gradually from outside to inside. Corresponding, the positioning part 311 of each elastic clamping sheet 31 also extends obliquely downwards in a direction from the connecting part 312 to the extension part 313, thereby further limiting the elastic clamping sheet 31 and preventing the elastic clamping sheet 31*a* from escaping from the press-fit part. During mounting, since the right side of the press-fit part 23*a* is higher than the left side, the lampshade 30 may be mounted tightly while being rotated clockwise, and loosened while being rotated anticlockwise, such that the lampshade 30 may be withdrawn just by pushing upwards slightly and rotating.

From the above, according to the fast-mounted ceiling lamp disclosed by the present invention, by arranging the hook on the mounting frame, the base can be directly hooked to the mounting frame when a wire on the base is connected to or disconnected from an external wire, without manual lifting, and therefore the operation is more convenient and the working efficiency is high. In addition, due to the arrangement of the elastic clamping sheets and the mounting parts, the elastic clamping sheets are rotatably clamped to the mounting parts, such that the base can be connected to or disconnected from the lampshade conveniently, and the mounting is stable. The fast-mounted ceiling lamp disclosed by the present invention has the advantages of strong practicability and great significance in promotion.

The above embodiments only express two implementations of the present invention and are described more specifically in detail, but may not be construed as limiting the scope of the present invention. It should be noted that, for those common skilled in the art, several deformations and improvements made without departing from the concept of the present invention will fall into the protection scope of the present invention. The scope of protection of the invention patent shall be subject to the appended claims.

What is claimed is:

1. A fast-mounted ceiling lamp convenient in wiring, comprising a mounting frame, a base, a light source assembly and a lampshade, wherein a crossbeam and vertical beams arranged at two ends of the crossbeam are arranged on the mounting frame, wherein a hook is arranged at the end of one vertical beam; a clamping ring is arranged on an outside wall of the base, the hook is hooked into the clamping ring, and the other vertical beam of the mounting frame is fixedly connected to the base; a plurality of mounting parts are also arranged on the outside wall of the base; a concave press-fit part is arranged in the middle of a top surface of each mounting part; a plurality of elastic clamping sheets are arranged on an inside surface of the lampshade; each elastic clamping sheet comprises a positioning part, and a connecting part and an extension part which are connected to two ends of the positioning part, wherein the connecting part is fixed inside the lampshade; the lampshade is adapted to the base; the lampshade is rotated to clamp the elastic clamping sheets into the mounting parts; the positioning part of each elastic clamping sheet is clamped to the press-fit part of the corresponding mounting part; the lampshade and the base define an accommodating space in which the light source assembly is mounted.

2. The fast-mounted ceiling lamp convenient in wiring according to claim 1, wherein the positioning part is arranged horizontally; the extension part extends obliquely towards the outer side above the lampshade; the connecting part is U-shaped and arranged below the outer side of the positioning part, and an opening of the connecting part faces upwards.

3. The fast-mounted ceiling lamp convenient in wiring according to claim 2, wherein a corner is arranged at positions where the positioning part, the extension part and the connecting part are connected, respectively; faces of the corner, which are in contact with the base, are arc-shaped respectively.

4. The fast-mounted ceiling lamp convenient in wiring according to claim 1, wherein a bottom end surface of the positioning part protrudes downwards to form a plurality of raised points; a surface of each raised point, which is in contact with the mounting part, is arc-shaped.

5. The fast-mounted ceiling lamp convenient in wiring according to claim 1, wherein an annular limiting plate is arranged on the lampshade; the limiting plate is provided with a plurality of step surfaces which are arranged in a form of steps; the elastic clamping sheets are fixedly arranged on the step surface at the outermost side.

6. The fast-mounted ceiling lamp convenient in wiring according to claim 1, wherein a guide part is arranged at the left side of the press-fit part in an extension direction of the mounting part; a limiting part is arranged at the right side of the press-fit part; the limiting part protrudes out of the press-fit part; the guide part is arranged obliquely downwards from left to right.

7. The fast-mounted ceiling lamp convenient in wiring according to claim 1, wherein a limiting part is respectively arranged at two sides of the press-fit part; the limiting parts protrude out of the press-fit part; the press-fit is arranged obliquely in a direction from one limiting part to the other limiting part.

8. The fast-mounted ceiling lamp convenient in wiring according to claim 6, wherein a top surface of a cross section of the press-fit part is of a structure which descends from outside to inside; the shape of the positioning part of the elastic clamping sheet is the same as that of the top surface of the cross section of the press-fit part.

9. The fast-mounted ceiling lamp convenient in wiring according to claim 7, wherein a top surface of a cross section of the press-fit part is of a structure which descends from outside to inside; the shape of the positioning part of the elastic clamping sheet is the same as that of the top surface of the cross section of the press-fit part.

10. The fast-mounted ceiling lamp convenient in wiring according to claim 1, wherein the crossbeam is provided with positioning holes, and screws penetrate through the positioning hole to fix the mounting frame onto a ceiling or a wall.

11. The fast-mounted ceiling lamp convenient in wiring according to claim 1, wherein the elastic clamping sheet is made of a metal material.

* * * * *